US011859864B1

(12) United States Patent
Nygaard

(10) Patent No.: US 11,859,864 B1
(45) Date of Patent: Jan. 2, 2024

(54) PARTICULATE AND VIRUS BARRIER

(71) Applicant: Wunderlich-Malec Engineering, Inc., Eden Prairie, MN (US)

(72) Inventor: Timothy Charles Nygaard, Hammond, WI (US)

(73) Assignee: WUNDERLICH-MALEC ENGINEERING, INC., Eden Prairie, MN (US)

( * ) Notice: Subject to any disclaimer, the term of this patent is extended or adjusted under 35 U.S.C. 154(b) by 215 days.

(21) Appl. No.: 17/323,528

(22) Filed: May 18, 2021

Related U.S. Application Data

(60) Provisional application No. 63/026,474, filed on May 18, 2020.

(51) Int. Cl.
*F24F 9/00* (2006.01)
*F24F 8/108* (2021.01)

(52) U.S. Cl.
CPC ..... *F24F 9/00* (2013.01); *F24F 8/108* (2021.01); *F24F 2009/002* (2013.01)

(58) Field of Classification Search
CPC ..... F24F 9/00; F24F 8/108; F24F 2009/002; F24F 2009/007; F24F 2120/12; F24F 1/0047; F24F 3/044; F04D 29/4226; F04D 29/665; F04D 29/44; F04D 29/441; E05Y 2400/822; G08B 5/36
USPC ..... 454/187, 189
See application file for complete search history.

(56) References Cited

U.S. PATENT DOCUMENTS 3,385,036 A * 5/1968 Webb ..... F24F 9/00 55/467
3,625,133 A * 12/1971 Hayashi ..... F24F 9/00 454/189
3,820,536 A * 6/1974 Anspach et al. ..... F24F 3/163 128/853

(Continued)

FOREIGN PATENT DOCUMENTS

DE 19827449 A1 * 1/1999 ..... B04D 46/10
GB 2422426 A 7/2006

(Continued)

OTHER PUBLICATIONS

Hanchen Suspended ESD Ionizer Ionizing Air Blower Anti Static Ionizer 4 Fan Industrial Electrostatic Eliminator Overhead Anti-Static Ionizer Track Air Blower CE Certificate (TR7004); https://www.amazon.com/Hanchen-Industrial-Electrostatic-Eliminator-Anti-Static/dp/B07Q3V97YT; retrieved May 7, 2020.

(Continued)

*Primary Examiner* — Edelmira Bosques
*Assistant Examiner* — Frances F. Hamilton
(74) *Attorney, Agent, or Firm* — Angela Holt; Bradley Arant Boult Cummings LLP

(57) ABSTRACT

An air plenum provides protection from viruses and particulates to a user located beneath the air plenum. The air plenum has a housing with a fan centrally located within the housing. Low-velocity air is emitted downwardly from the fan through a perforated screen on a lower side of the housing onto the user. A slot diffuser extends around a lower periphery of the housing and emits high-velocity air downwardly to form an air curtain around the user. The higher velocity air of the air curtain reduces the ability of unwanted particulate matter to enter the area that is below the perforated screen.

15 Claims, 7 Drawing Sheets

(56) References Cited

U.S. PATENT DOCUMENTS 4,045,192 A * 8/1977 Eckstein ..... A61G 10/02 96/365
4,131,059 A * 12/1978 Gustavsson ..... F24F 13/06 454/52
4,427,427 A * 1/1984 DeVecchi ..... B01D 46/12 55/385.2
4,560,395 A * 12/1985 Davis ..... F24F 8/108 55/385.2
4,565,075 A * 1/1986 Drucker ..... F24F 13/0236 165/122
4,967,320 A * 10/1990 Paschal ..... F24F 9/00 433/136
5,053,065 A 10/1991 Garay
5,129,928 A * 7/1992 Chan ..... F24F 8/108 55/472
5,312,465 A * 5/1994 Riutta ..... B01D 46/0049 55/471
5,350,337 A * 9/1994 Kondo ..... F24F 9/00 454/189
5,406,073 A * 4/1995 Sharp ..... G01V 8/10 250/221
6,019,808 A * 2/2000 Ishikawa ..... F24F 13/28 55/385.2
6,099,607 A * 8/2000 Haslebacher ..... F24F 3/163 55/482
6,217,281 B1 * 4/2001 Jeng ..... F04D 29/703 415/119
6,342,005 B1 * 1/2002 Daniels ..... F24F 13/24 454/906
6,811,593 B2 11/2004 Hansson et al.
7,044,850 B2 * 5/2006 Koch ..... F24F 9/00 454/189
7,753,977 B2 7/2010 Lyons et al.
8,066,802 B2 11/2011 Kristensson et al.
9,144,697 B2 * 9/2015 Augustine ..... A61M 16/107
9,375,547 B2 6/2016 Augustine et al.
10,537,655 B2 1/2020 Wesen et al.
2002/0011938 A1 * 1/2002 Krieger ..... B60Q 9/004 340/425.5
2003/0153260 A1 * 8/2003 Kristensson ..... F24F 5/0042 454/338
2004/0003617 A1 * 1/2004 Chandler ..... F25D 23/023 62/256
2005/0287945 A1 * 12/2005 Choi ..... F24F 12/006 454/234
2006/0277873 A1 * 12/2006 Lyons ..... F24F 3/163 55/416
2008/0022596 A1 * 1/2008 Boerger ..... E06B 9/82 49/31
2008/0279681 A1 * 11/2008 Eguchi ..... F04D 29/444 415/206
2010/0081368 A1 * 4/2010 Della Valle ..... A61G 13/108 454/228
2012/0085231 A1 * 4/2012 Kristensson ..... F24F 11/80 96/397
2013/0213614 A1 * 8/2013 Ikeda ..... F24F 1/0014 165/104.34
2017/0191684 A1 * 7/2017 Tompkins ..... A47C 21/044
2019/0003480 A1 * 1/2019 Hall ..... F04D 27/00
2021/0348783 A1 * 11/2021 Adkins ..... F24F 8/22
2022/0034548 A1 * 2/2022 Atatekin ..... F24F 7/007

FOREIGN PATENT DOCUMENTS

JP 2006207845 A * 8/2006
KR 20090039160 A * 10/2007
KR 102154848 B1 * 9/2020
KR 102310792 B1 * 1/2021
WO WO-8504240 A1 * 3/1985
WO 199819646 5/1998
WO 2011092448 A1 8/2011

OTHER PUBLICATIONS

Air Showers; bioBubble, Inc.

* cited by examiner

PARTICULATE AND VIRUS BARRIER

REFERENCE TO RELATED APPLICATIONS

This application claims priority to Provisional Patent Application U.S. Ser. No. 63/026,474, entitled "Particulate and Virus Barrier at Point of Customer Interaction" and filed on May 18, 2020, which is fully incorporated herein by reference.

BACKGROUND AND SUMMARY

This disclosure relates to the air filtration system and technique for providing air filtration and pressurization together creating an air barrier to specific areas where employees interact with the public or work in close proximity to others during the course of business to limit the transfer of particulates and viruses.

Employees in businesses that interact with the public and manufacturing processes are often working within close proximity and they are at increased risk of transmission of common particulates including viruses that can be carried and easily transmitted via air. Some of the common locations that this may occur would be at commercial and private point of sale locations such as, but not limited, to supermarkets, bars, restaurants, retail stores, manufacturing lines, meat processing plants and many other instances where there are high levels of person-to-person interaction as a part of normal business.

Typical person-to-person interaction locations within business do not have a system specifically designed to provide air in a filtered, ionized and pressurized area for employees or customers to have close interaction or at less than a minimum distance of six feet per CDC guidelines. Most facilities have a very general air distribution systems that only meet the capacity of the air required to supply the overall facility to meet code requirements in an economical fashion as specified during the original design and construction of the building.

These systems typically have little excess air flow capacity or adequate static pressure capacity to support additional devices for air filtration, ionization and localized distribution used in creating distinct pressurized and filtered zones.

The current methods of limiting air and particulate transfer from customers to employees include physical barriers or other materials used to create a barrier. These systems generally do not provide a pressurized and filtered barrier for the occupant's immediate space allowing the airborne particulates and viruses the opportunity to pass unfiltered beyond the current unpressurized physical barrier. The existing methods of providing a barrier to stop the transfer of particulates and viruses have drawbacks.

The modular system according to the present disclosure produces a shower of HEPA filtered and ionized air around the employee giving them the primary benefit of a continuous supply of clean air. The employees or public around them will obtain the secondary benefit of filtered and ionized air. This system is a modular self-contained unit that can be installed in various locations. The key to this system is providing high volumes of HEPA filtered air at a low velocity in the center of the unit over the employee with a high-volume high-velocity air curtain around the perimeter creating a personal "bubble" of highly filtered and ionized air delivered in a modular floor-supported unit. An air plenum is the key to pulling multiple technologies together into one unit. All airflow will be directed over the employee and end up near the floor where ionized particulates will remain as harmless particulate. Any particulate of virus that is trapped in the HEPA filter within the air plenum will be destroyed by the ionization and left as harmless particulate and will remain trapped in the filter until it is changed.

The amount of filtered and pressurized air in a specific area can create an effective barrier as part of this modular system/air plenum and will offer protection to employees and customers beyond the minimal capabilities of a physical barrier or no barrier by creating a positive pressure area of filtered air that will capture and restrict the particulates and viruses from passing thru to a defined area to occupied by employees and customers spaces. Filters will be of the proper MERV rating to support virus and particulate capture. Additional optional features include LED lighting, PC-based message display board for customer communication and laser light curtain area identification within the design and equipment.

The filtered and pressurized zones are linkable and wired to provide easy methods to adapt multiple units together to supply larger areas. The unit is supported from a floor-anchored post or suspended from structure above with a typical discharge height at approximately 9'-0" above the floor.

The energy consumption is minimal with a high efficiency fan. Heat gain to the space is minimal due to the high efficiency of all equipment. The Systems utilize pre-filters that extend the life of the HEPA filters significantly. The systems can be fitted with SCR electric heat with a capability to increase discharge air temperature by about 3 degrees F. This amount of heat will offset any cooling effect the person working below the unit will experience from the air movement over them.

The system operates independent of existing HVAC systems and does not introduce any additional air into the building.

System controls can be integrated to meet customer needs as a packaged system that will interface with any fire protection system for emergency shut down or building management system in the event of an emergency. Individual zone and overall airflow rates can be monitored and maintained thru system balancing and devices that are capable of providing feedback to set rates at the devices or a control system, allowing it to operate as a stand-alone system or fully integrated system.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
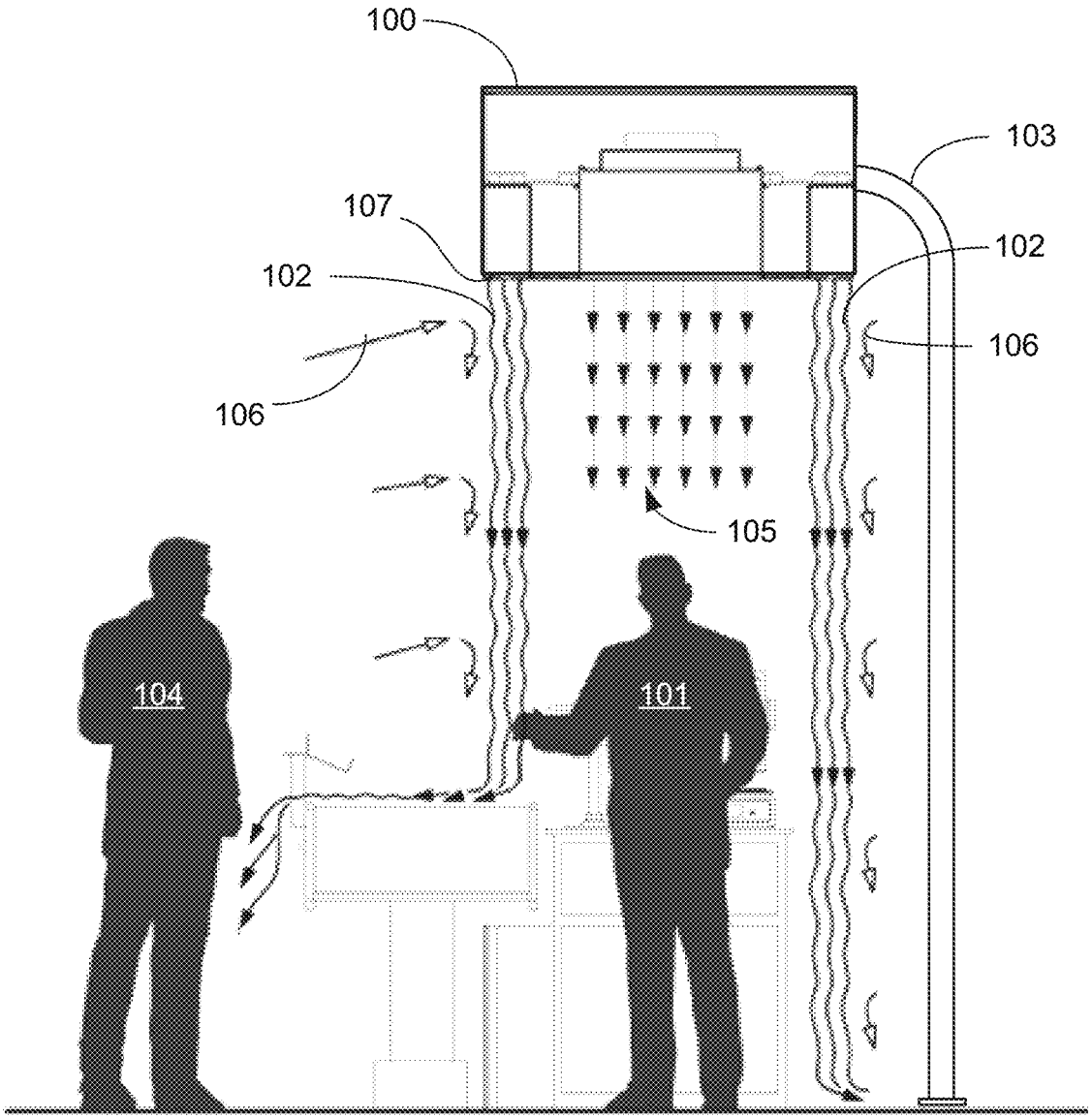
FIG. 1 depicts an air plenum according to an exemplary embodiment of the present disclosure.

FIG. 1 depicts an air plenum 100 according to an exemplary embodiment of the present disclosure. The plenum 100 is suspended above a user 101 who is to be protected from contaminants. The plenum 100 directs air downwardly through slot diffusers (not shown) to create an "air curtain" 102 around the user 101. Although the air curtain 102 is illustrated as extending downwardly on only two sides of the user 101, the air curtain 102 actually is emitted around the entire periphery of the rectangular air plenum 100, as further discussed herein, protecting the user 101 on all four sides. The air curtain 102 prevents contaminates 106, such as viruses, from being transmitted by a person 104 in the vicinity of the user 101. The user 101 may be, for example, a cashier at a grocery store. In this situation, the air curtain 102 protects the user 101 from particles and viruses that may be emitted by the person 104 that is a customer.

Directly above the user 101, low velocity air 105 is emitted from the air plenum. The low velocity air 105 passes through a HEPA filter (not shown) within the air plenum 100, as further discussed herein.

A support post 103 extends from the air plenum 100 and supports the air plenum 100 from a surface (not shown), such as the floor of a store. The support post 103 is sized such that a lower edge 107 of the air plenum is about nine feet from the floor. A range of between eight and ten feet from between the floor (or surface that the user 101 is disposed on) and the lower 107 edge of the air plenum is acceptable. Raising the air plenum 100 too high would result in the airflow rate of the air curtain 102 dropping too dramatically as it reaches the floor.

The high-velocity air emitted from the slot diffusers to form the air curtain is at least 450 feet/minute at a distance of twelve (12) inches beneath the lower edge 107 of the air plenum 100. A range of between 450 FPM and 475 FPM is acceptable at this distance. At a distance of three (3) feet beneath the lower edge 107 of the air plenum 100, the air velocity should be about 250 feet per minute. A range of between 250 FPM and 275 FPM is acceptable at this distance.

The high-volume, low velocity air 105 emitted through the center of the air plenum 100 should generally be no greater than 50 feet per minute at the discharge of the HEPA filter, though a range of 50-60 FPM should be acceptable. At that rate, a high-pressure zone can be formed within the air curtain 102 that helps to prevent contaminated air from outside of the area from reaching the user 101.

In the illustrated embodiment, a support flange 202 disposed on the lower end of the support post 103 is configured to be bolted to the floor. In other embodiments, the air plenum 100 may be suspended from structure (not shown) from above the user 101 (FIG. 1).

Figure 2:
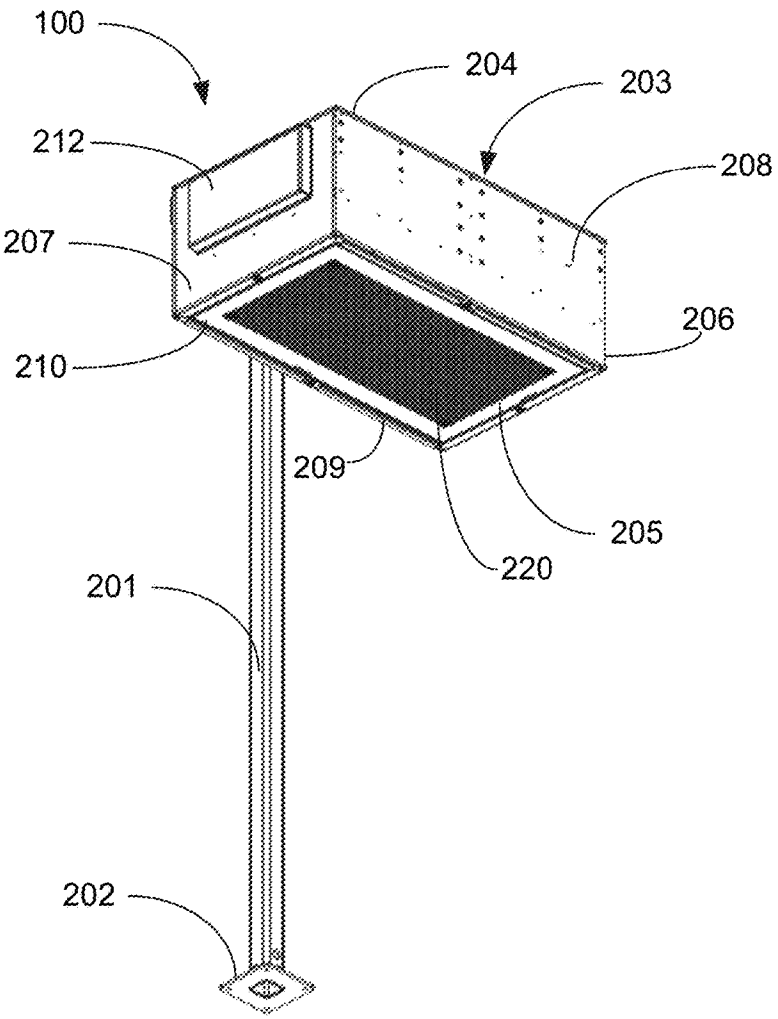
FIG. 2 is front perspective view of the air plenum according to an embodiment of the present disclosure.

FIG. 2 is front perspective view of the air plenum 100 according to an embodiment of the present disclosure. In the illustrated embodiment, the air plenum 100 has a rectangular housing 203 with a top side 204, a bottom side 205, a right side 206, a left side 207, a front side 208 and a rear side 209. In one embodiment the air plenum 100 is about 4 feet, 11 inches wide by 2 feet, 11 inches deep by 1 foot, 11 inches high, though other dimensions may be used in other embodiments. A goal in sizing the air plenum 100 was that the air curtain 102 (FIG. 1) will fully protect a user disposed beneath the air plenum 100.

Air enters the air plenum 100 via one or more openings (not shown) on the left side 207 of the air plenum 100. An air pre-filter 212 is disposed on the left side 207 of the air plenum 100 and covers the openings. The air pre-filter 212 filters air prior to the air entering the air plenum 100.

The bottom side 205 of the housing 203 comprises slot diffusers 210 extending along four sides of the housing 203 around a perimeter of the bottom side 205, near the edges. The slot diffusers 210 comprise a slot extending continuously around the perimeter of the bottom side 205 about an inch from each of the four (4) edges of the bottom side 205, as further discussed herein. Air exits the slot diffusers 210 downwardly to form the air curtain 102 (FIG. 1), as further discussed herein.

A portion of the air exits the air plenum 100 via a perforated screen 220 that permits air flow through a HEPA filter (not shown) when the air plenum 100 is in use. The portion of air that passes through the screen 220 is high-volume, low-velocity air, as further discussed herein.

Figure 3:
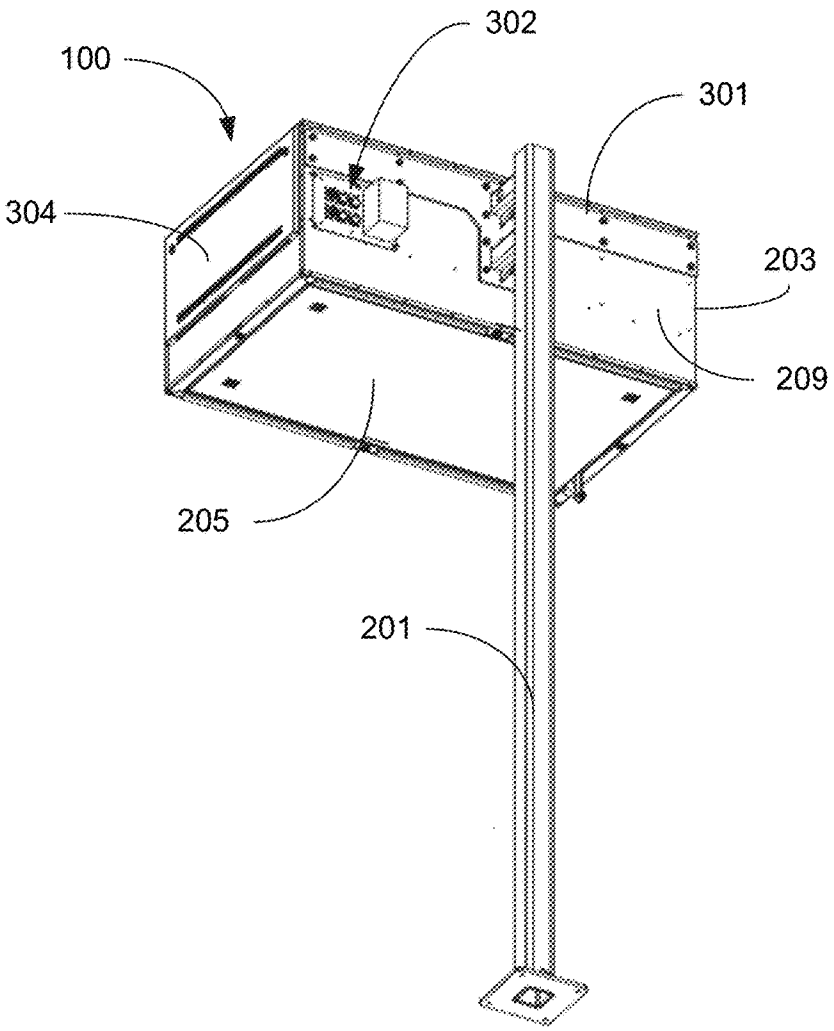
FIG. 3 is a rear perspective view of the air plenum of FIG. 2.

FIG. 3 is a rear perspective view of the air plenum 100 of FIG. 2. A rear support bracket 301 extends horizontally along an upper edge of the rear side 209 of the housing 203. The rear support bracket 301 is releasably affixed to the support post 103 and to the rear side 209 of the housing 203.

An electrical control panel 302 is also disposed on the rear side 209 of the housing 203. The electrical control panel 302 provides access to electrical control components within the air plenum 100. As further discussed herein with respect to FIG. 4., the electrical control panel 302 is slideably removable from the air plenum 100 for easy access to repair or replace electrical components.

An end cover 304 is disposed on a right side of the air plenum 100. The end cover 104 is hingedly affixed to the housing 203 and configured to allow access to the interior of the air plenum 100 for maintenance of the internal electrical equipment (not shown). A lock (not shown) will secure the end cove 304. (Note that the perforated screen 200 (FIG. 2) is not shown in FIG. 3.)

Figure 4:
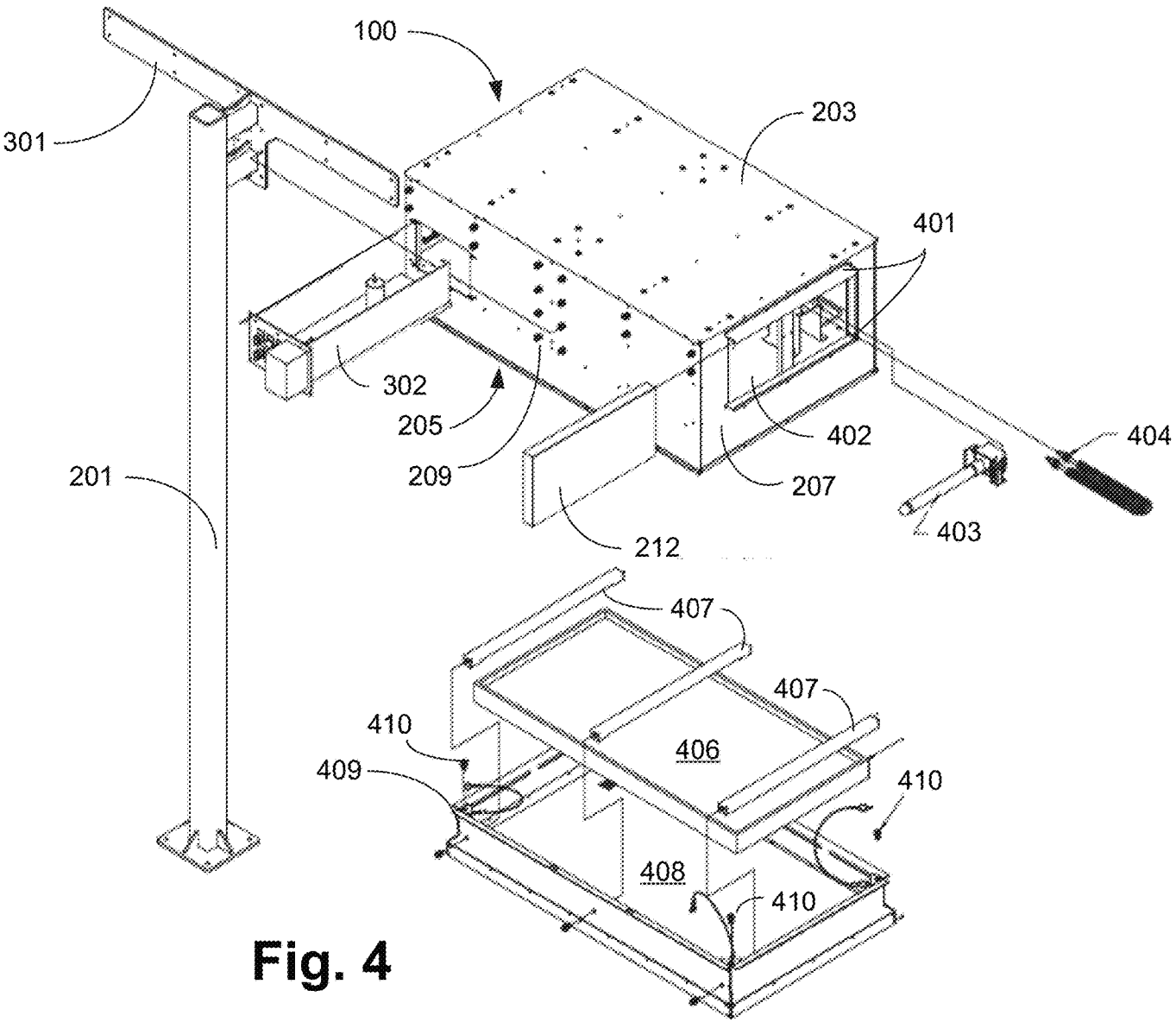
FIG. 4 is a partially-exploded rear perspective view of the air plenum of FIG. 2

FIG. 4 is a partially-exploded rear perspective view of the air plenum 100 of FIG. 2. The rear support bracket 301 is releasably affixed to the support post 103 and to the rear side 209 of the housing 203.

The air pre-filter 212 slides into filter brackets 401 on the right side 207 of the housing 203, covering an air inlet opening 402 when installed. The air pre-filter 212 is configured to prevent coarse particulate from entering the air plenum, which will extend the life of the HEPA filter.

Removal of the air pre-filter 212 provides access for accessing an ionization unit 403 and an air heater 404. The ionization unit 403 ionizes the air as it enters the air plenum 100, neutralizing any active viruses that may be in the air. In this regard, the ionization unit 403 ionizes the air with a positive and negative charge, while producing no ozone. The ionization nit 403 will keep the air plenum components free of germs, viruses and particulates by continuously producing ionized air.

The air heater 404 can be activated to prevent the air flowing down onto the user from becoming uncomfortably cool. In one embodiment, the air heater 404 is an electric 1500 Watt SCR controlled heater configured to raise the air discharge temperature by about 3 degrees F. to offset any cooling effect the air has from being delivered at a nominal velocity over the user below the air discharge of the unit.

A HEPA filter 406 fits within a filter housing 409 on the bottom side 205 of the housing 203. The HEPA filter 406 is comprised of synthetic media with minimal static pressure drop. A set volume of low velocity air (not shown) will pass through the HEPA filter to provide filtered air directly below the filter discharge in a linear pattern.

The filter housing 409 comprises a perforated screen 220 (FIG. 2) that permits air flow through the HEPA filter 406 when the air plenum 100 is in use. The screen 220 aids in even distribution of the air. A plurality of filter retaining bars 407 retain the HEPA filter 406 within the filter housing 409. The filter housing 409 is releasably affixed to the bottom side 205 of the housing 203 with a plurality of fasteners 410.

Figure 5:
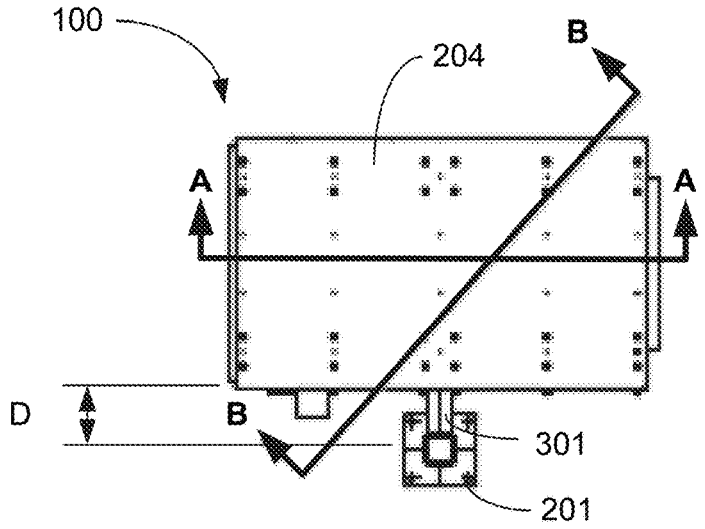
FIG. 5 is a top view of the air plenum of FIG. 2.

FIG. 5 is a top view of the air plenum 100 of FIG. 2. The air plenum 100 is configured such that the internal components can be accessed from the side or back, and there is no need to access the top side 204 of the air plenum 100 once it has been installed. In embodiments where the air plenum is desired to be suspended from above, rather than with the support post 103, support brackets (not shown) may be affixed to the top side 204 of the air plenum.

Note that the support post 103 is offset from a footprint of the air plenum 100, such that the support post 103 does not interfere with the user (not shown) when the user is beneath the air plenum 100. The distance "D" that the support post 103 is offset from the air plenum 100 is driven by the depth of the rear support bracket 301.

Figure 6:
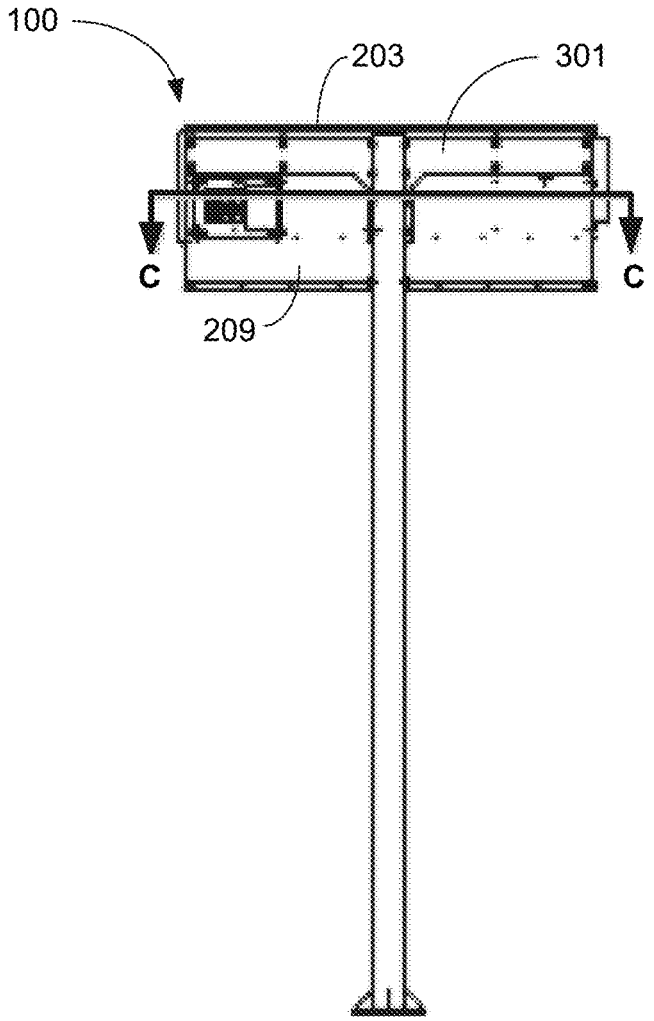
FIG. 6 is a rear view of the air plenum of FIG. 2.

FIG. 6 is a rear view of the air plenum 100 of FIG. 2. The rear support bracket 301 is generally "T"-shaped and extends horizontally across the back of the housing 203, near the top edge of the rear side 209 of the housing 203.

Figure 7:
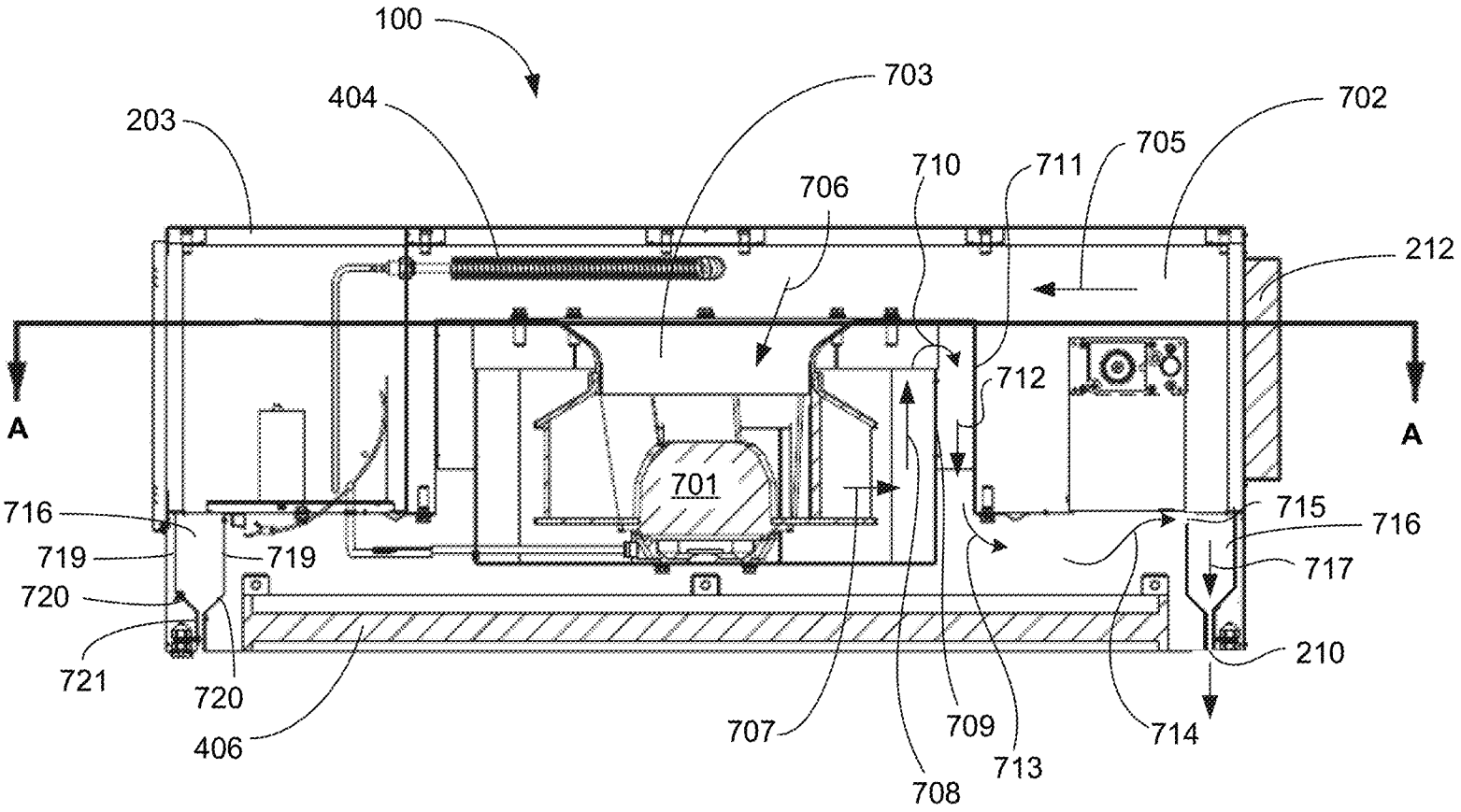
FIG. 7 is a cross-sectional view of the air plenum of FIG. 5, taken along section lines A-A of FIG. 5.

FIG. 7 is a cross-sectional view of the air plenum 100 of FIG. 5, taken along section lines A-A of FIG. 5. The air plenum 100 comprises a diffusing fan 701 centrally located within the housing 203. The fan 701 directs air that enters the air plenum 100 downwardly and disperses it between the HEPA filter 406 and the slot diffusers 210 that forms the air curtain (not shown) discussed herein. In one embodiment the fan 701 comprises a fixed pitch high efficiency direct drive fan with variable speed. The fan 701 has significant static pressure capability to overcome the associated losses with the filtration and distribution within the air plenum 100 out to the discharge points at the slot diffusers and HEPA filter 406. In one embodiment, the fan is capable of moving air at a minimum of 1500 cubic feet per minute (CFM).

In operation of the air plenum 100, air enters the air plenum 100 through the air pre-filter 212 and travels generally horizontally as indicated by directional arrow 705 within an interior chamber 702 of the air plenum 100. The air is then drawn downward into the fan 701 as indicated by directional arrow 706. Air exists the fan 701 is indicated by directional arrow 707. When the air leaves the fan, it is in a rotating pattern. The air collides with an inner fan wall 709 that surrounds the fan 701 and is forced upwards as indicated by directional arrow 708. The air passes over the inner fan wall 709, as indicated by directional arrow 710 and is forced downwardly by an outer fan wall 711. The air being forced over the inner fan wall 709 in a "U"-shape helps to reduce air noise. Additionally, the air passing over the inner fan wall 709 disperses air pressure in a pattern that allows the air to enter the inner slit 715 (discussed below) in a uniform manner. The air then travels radially above a HEPA filter 406 in multiple streams, as indicated by directional arrow 713.

The air then arrives at the edges of the air plenum 100, where it enters a peripheral air duct 716 via an inner slit 715, as indicated by directional arrow 714. In one embodiment, the inner slit 715 is about ½ inches wide, and extends uniformly around the periphery of the air plenum 100 about one inch from the outer edges.

The peripheral air duct 716 extends around the entire periphery of the lower edges of the housing 213 and forces the air downwardly (as indicated by directional arrow 717) out of the slot diffusers 210 to form the air curtain 102 (FIG. 1). The peripheral air duct 716 is about six inches wide and twelve inches high in one embodiment. The peripheral air duct 716 comprises straight side walls 719, parallel to and spaced apart from one another. The straight side walls 719 transition to angled side walls 720 on opposed sides of the duct, as illustrated. The angled side walls 720 narrow the peripheral air duct down to a narrow spout portion 721, which is coextensive with the slot diffuser 210 (i.e., the slit that the air exits the peripheral air duct from). The cross-section of the peripheral air duct 716 is thus shaped like a funnel, which serves to increase the velocity of the air leaving the duct 716. The slot diffuser 210 is about ⅜ inches wide in the illustrated embodiment.

Figure 8:
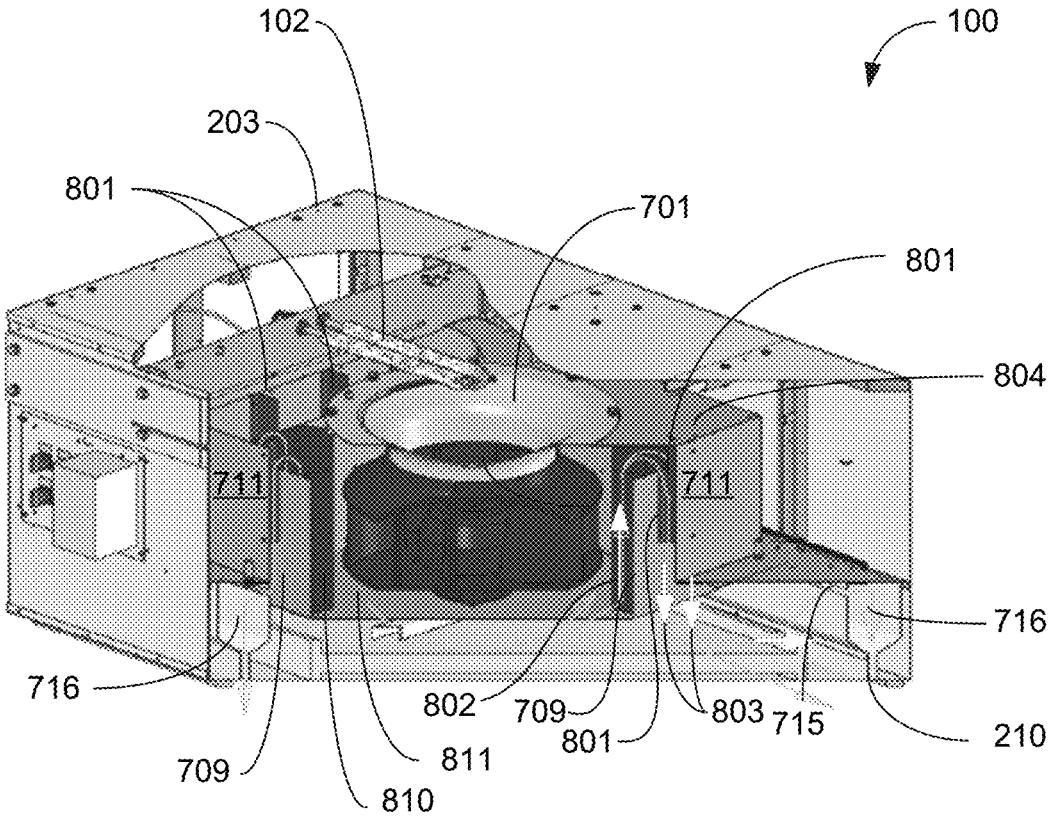
FIG. 8 is a partial cross-sectional cutaway representation of the air plenum of FIG. 5, taken along section lines B-B of FIG. 5.
Figure 9:
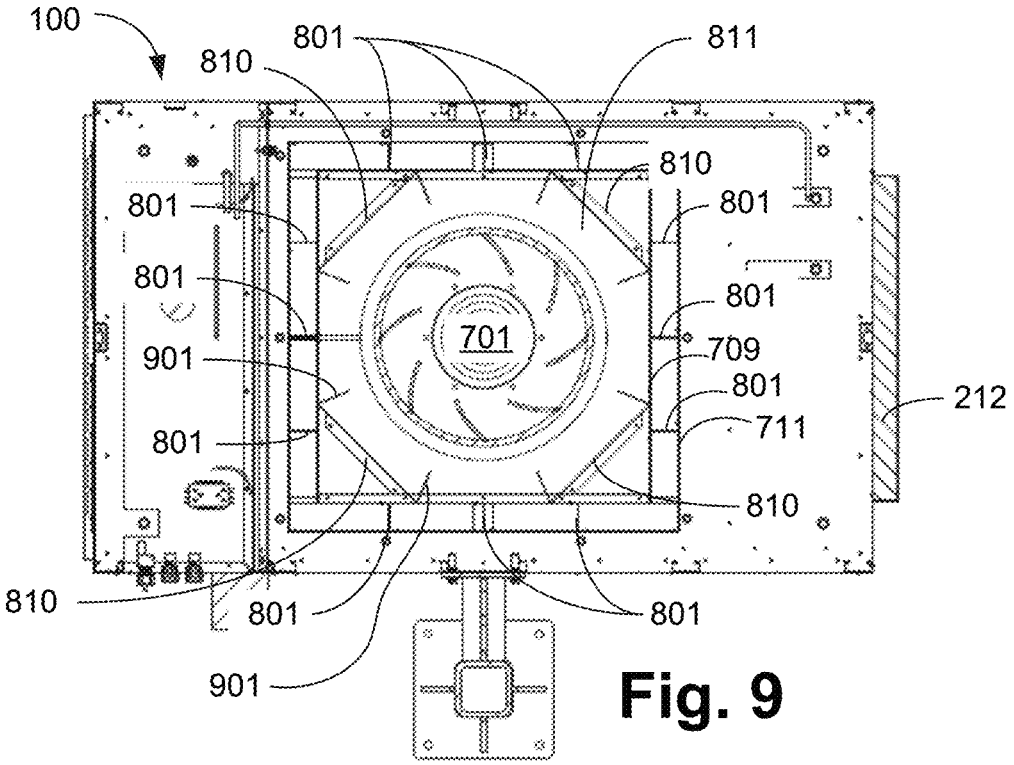
FIG. 9 is a cross-sectional view of the air plenum of FIG. 6, taken along section lines C-C of FIG. 6.

FIG. 8 is a partial cross-sectional cutaway representation of the air plenum 100 of FIG. 5, taken along section lines B-B of FIG. 5. As discussed above with respect to FIG. 7, in operation of the air plenum 100, the fan 701 drives air flow down through the air plenum 100. An inner fan wall 709 surrounds the fan 701 in the shape of a square, as can be seen more clearly in FIG. 8. The inner fan wall 709 forms a fan chamber 811 in the shape of a square. A corner baffle 810 is disposed in each corner of the fan chamber. (Two sets of corner baffles 810 are partially shown in blue in FIG. 8. Refer to FIG. 9 for a top view of the corner baffles 810.) The corner baffles 810 serve to concentrate the air within the fan chamber 811. Without the corner baffles 810, air would be pushed into the corners within the fan chamber 811, decreasing air flow.

The air leaving the fan 701 is forced upwards by the inner fan wall 709 which surrounds the fan 701, in the direction indicated by directional arrow 802. When the air reaches a top fan wall 804 it is forced downward against the outer fan wall 711, which surrounds the fan outwardly from and spaced apart from the inner fan wall 709.

A plurality of air straighteners 801 are affixed to the outer fan wall 711 and extend inwardly, towards the fan 701. Each air straightener 801 comprises a thin strip of sheet that extends about an inch and a quarter towards the fan 701. The air straighteners 801 serve to "split" the air flow, as indicated by directional arrows 803. The air straighteners 811 extend vertically from the top fan wall 804 about ⅔ of the way down the outer fan wall 711. Terminating the air straighteners before they reach the bottom of the outer fan wall 711 serves to give the air flowing downwardly sufficient clearance to smoothly exit the space, and also helps with sound attenuation/noise reduction. Note that the outer fan wall 711 does not extend downwardly as far as the inner fan wall.

As discussed above, air enters the peripheral air duct 716 via the inner slit 715, and is then forced downwardly from the slot diffusers 210.

FIG. 9 is a cross-sectional view of the air plenum 100 of FIG. 6, taken along section lines C-C of FIG. 6. The air straighteners 801 extend between the inner fan wall 709 and the outer fan wall. In the illustrated embodiment, there are three (3) air straighteners spaced apart on each of the four walls of the fan chamber, for a total of twelve (12) air straighteners.

As shown in the drawing, a corner baffle 810 is disposed in each corner of the fan chamber 811. Each corner baffle 810 comprises a long side 902 that extends between adjacent inner fan walls 709. The corner baffles 810 extend vertically from the top fan wall 804 to a bottom surface of the fan chamber 811. A baffle extension 901 extends inwardly from each end of the long side 902 of the corner baffle 810. The baffle extensions are angled generally toward the center of the fan 701. The baffle extensions extend about 1-¼ inches in the illustrated embodiment. The baffle extensions are riveted to the bottom surface of the fan chamber 811.

Figure 10:
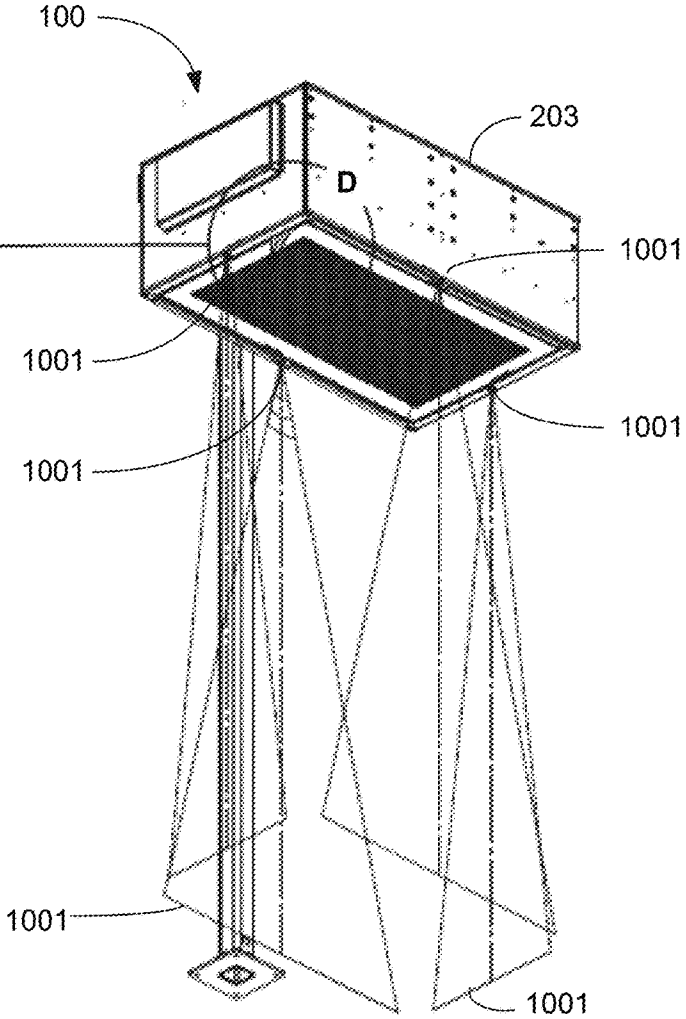
FIG. 10 is a perspective view of an embodiment of an air plenum including laser markers to define the area of the air curtain.

FIG. 10 depicts an embodiment of the air plenum that includes laser markers 1101 directly downwardly from each side of the housing 203 to project a laser lines 1001 on the floor. The laser lines define a rectangle within which the user (not shown) will be protected by the air curtain as discussed herein. In one embodiment, the laser markers 1101 are held in place via a compression-style holder (not shown) that allows for adjustment and replacement of the laser markers 1101.

Figure 11:
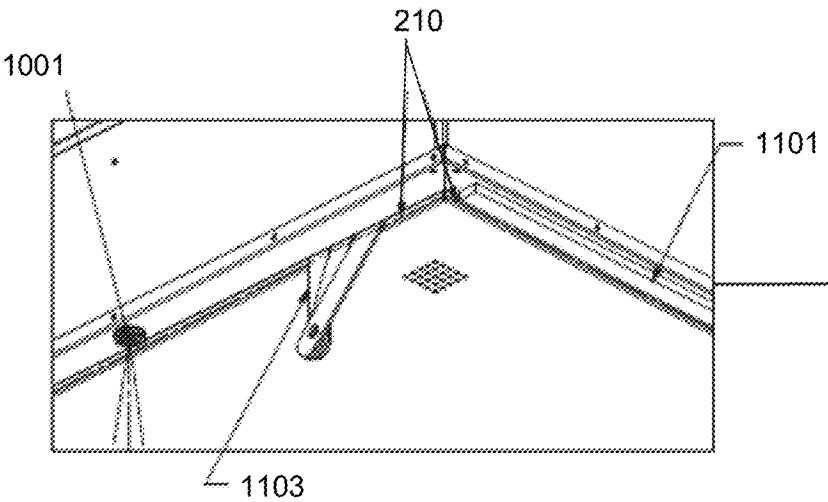
FIG. 11 is an enlarged detail view of the air plenum of FIG. 10, taken along detail line "D" of FIG. 10.

FIG. 11 is an enlarged detail view of the air plenum of FIG. 10, taken along detail line "D" of FIG. 10. The slot diffusers 210 are shown extending along the perimeter of the housing as discussed herein. A feeler gauge 1103 is illustrated within the slot diffuser 210 for illustrative purposes. An LED strip 1101 is affixed to the perimeter of the housing 203 in this embodiment for additional lighting to prevent shadows below the air plenum 101.

What is claimed is:

1. An air plenum comprising:

a housing;

a fan centrally located within the housing, the fan configured to emit low-velocity air downwardly through a perforated screen disposed on a lower side of the housing onto a user located beneath the housing;

a slot diffuser extending continuously around a lower periphery of the housing, the slot diffuser configured to emit high-velocity air downwardly from the lower side of the housing to form an air curtain around the user;

a fan chamber surrounding the fan, the fan chamber shaped in a square, the fan chamber comprising corner baffles, wherein each corner baffle blocks off a corresponding corner of the fan chamber to concentrate air in the fan chamber, wherein the fan chamber further comprises an inner fan wall surrounding the fan, wherein the inner fan wall directs air upwardly over the inner fan wall in operation of the air plenum, wherein the fan chamber further comprises an outer fan wall surrounding the inner fan wall, wherein the outer fan wall is spaced apart outwardly from the inner fan wall, and wherein the outer fan wall is configured to direct air downwardly under the outer fan wall in operation of the air plenum.

2. The air plenum of claim 1, further comprising a high efficiency particulate air (HEPA) filter disposed between the fan and the perforated screen.

3. The air plenum of claim 1, wherein an air flow rate exiting the perforated screen is no greater than 50 feet per minute.

4. The air plenum of claim 1, wherein an air flow rate exiting the perforated screen is between 50 feet per minute and 60 feet per minute.

5. The air plenum of claim 1, wherein the fan is capable of moving air at a minimum of 1500 cubic feet per minute (CFM).

6. The air plenum of claim 1, further comprising a support post rigidly affixed to the housing and connected to the housing via a support bracket, the support post offset from a footprint of the housing.

7. The air plenum of claim 6, wherein the support post is configured to maintain the lower side of the housing between eight and ten feet from a surface upon which the user is standing.

8. The air plenum of claim 1, wherein the speed of air of the air curtain at a distance of twelve inches below the lower side of the housing is at least 450 feet per minute.

9. The air plenum of claim 8, wherein the speed of air of the air curtain at a distance of three feet below the lower side of the housing is at least 250 feet per minute.

10. The air plenum of claim 1, wherein the slot diffuser comprises a peripheral air duct extending around a periphery of the lower edges inside of the housing.

11. The air plenum of claim 10, wherein the peripheral air duct comprises an inner slit on its interior side for admitting air into the peripheral air duct, the inner slit extending around an inner perimeter of the peripheral air duct.

12. The air plenum of claim 1, wherein the fan chamber further comprises a plurality of air straighteners extending between the outer fan wall and the inner fan wall, and wherein the air straighteners are configured to split the air flow as the air moves upwardly between the inner fan wall and the outer fan wall.

13. The air plenum of claim 1, further comprising laser light markers directed downwardly from the housing to mark a perimeter of the air curtain on a surface below the air plenum.

14. The air plenum of claim 1, further comprising LED lights directly downwardly from the housing.

15. An air plenum comprising:

a housing;

a fan located within the housing, the fan configured to emit low-velocity air downwardly through a perforated screen disposed on a lower side of the housing onto a user located beneath the housing;

a slot diffuser extending around a lower periphery of the housing, the slot diffuser configured to emit high-velocity air downwardly from the lower side of the housing to form an air curtain around the user; and a fan chamber surrounding the fan, wherein the fan chamber comprises four corners and four corner baffles, wherein each of the four corner baffles blocks off a corresponding corner of the four corners to concentrate air in the fan chamber, wherein the fan chamber further comprises an inner fan wall surrounding the fan and an outer fan wall surrounding the inner fan wall, the outer fan wall spaced apart outwardly from the inner fan wall, wherein the inner fan wall is configured to direct air upwardly over the inner fan wall in operation of the air plenum and the outer fan wall is configured to direct air downwardly in operation of the air plenum.

* * * * *